US008947251B2

(12) United States Patent
Finkbeiner

(10) Patent No.: US 8,947,251 B2
(45) Date of Patent: Feb. 3, 2015

(54) LIFTING APPARATUS FOR LIFTING AND LOWERING LOADS, IN PARTICULAR VEHICLES

(76) Inventor: Gerhard Finkbeiner, Freudenstadt (DE)

( * ) Notice: Subject to any disclaimer, the term of this patent is extended or adjusted under 35 U.S.C. 154(b) by 183 days.

(21) Appl. No.: 13/696,648

(22) PCT Filed: Jun. 10, 2011

(86) PCT No.: PCT/EP2011/059674
§ 371 (c)(1),
(2), (4) Date: Nov. 7, 2012

(87) PCT Pub. No.: WO2011/154519
PCT Pub. Date: Dec. 15, 2011

(65) Prior Publication Data

US 2013/0049977 A1 Feb. 28, 2013

(30) Foreign Application Priority Data

Jun. 11, 2010 (DE) ..... 20 2010 007 856 U

(51) Int. Cl.
*G08B 21/00* (2006.01)

(52) U.S. Cl.
USPC ..... 340/686.1; 340/573.1; 187/210; 187/247; 254/89 R; 254/134; 362/89

(58) Field of Classification Search
USPC ..... 340/686.1, 573.1; 187/203, 207, 209, 187/224, 227, 390, 210, 247; 362/89, 90; 254/89 R, 134
See application file for complete search history.

(56) References Cited

U.S. PATENT DOCUMENTS

| | | | | |
|---|---|---|---|---|
| 4,086,982 | A * | 5/1978 | Hernick | 187/216 |
| 4,212,374 | A * | 7/1980 | Bubik | 187/204 |
| 4,520,343 | A * | 5/1985 | Koh et al. | 187/391 |
| 4,732,186 | A * | 3/1988 | Nishikawa | 134/123 |
| 5,116,264 | A | 5/1992 | Wiederrich et al. | |
| 6,186,280 | B1 * | 2/2001 | Healy | 187/207 |

(Continued)

FOREIGN PATENT DOCUMENTS

| | | | |
|---|---|---|---|
| DE | 833 684 | C | 3/1952 |
| DE | 19 84 742 | U | 5/1968 |
| DE | 91 04 973 | U1 | 6/1991 |
| DE | 299 19 217 | U1 | 2/2000 |

(Continued)

OTHER PUBLICATIONS

International Search Report for corresponding Patent Application No. PCT/EP2011/059674 dated Jun. 10, 2011.

*Primary Examiner* — Hung T. Nguyen
(74) *Attorney, Agent, or Firm* — Renner, Otto, Boisselle & Sklar, LLP

(57) ABSTRACT

A lifting apparatus for lifting and lowering loads, having a lifting arrangement, on which a load-bearing member is arrangeable, having a drive arrangement which moves the load-bearing member up and down, having a control arrangement which activates the drive arrangement and one or more lighting arrangements, wherein each lighting arrangement has a working-area lighting and an operating-state-display lighting for displaying at least one operating state, and in that each lighting arrangement is activated by the control arrangement in a working-area lighting mode or an operating-state display lighting mode or in both modes.

13 Claims, 7 Drawing Sheets

(56) References Cited

U.S. PATENT DOCUMENTS

| | | | | |
|---|---|---|---|---|
| 6,279,685 | B1 * | 8/2001 | Kogan et al. | 187/208 |
| 6,634,461 | B1 * | 10/2003 | Baker | 187/247 |
| 8,016,080 | B2 * | 9/2011 | Rossato | 187/207 |
| 8,708,107 | B2 * | 4/2014 | Finkbeiner | 187/393 |
| 2006/0192663 | A1 * | 8/2006 | Bryan et al. | 340/457.1 |
| 2009/0236183 | A1 | 9/2009 | Bordwell et al. | |

FOREIGN PATENT DOCUMENTS

| | | | |
|---|---|---|---|
| DE | 202 00 217 | U1 | 4/2002 |
| DE | 10 2007 024936 | A1 | 12/2008 |
| DE | 20 2009 00566 | U1 | 7/2009 |
| JP | H06 69038 | U | 9/1994 |

* cited by examiner

LIFTING APPARATUS FOR LIFTING AND LOWERING LOADS, IN PARTICULAR VEHICLES

The invention relates to a lifting apparatus for lifting and lowering loads, in particular vehicles, having a lifting arrangement on which a load-bearing means can be arranged, and having a drive arrangement which moves the load-bearing means up and down, which is activated by a control arrangement.

BACKGROUND

A lifting apparatus for lifting loads is known from DE 20 2009 005 661, which has a drive arrangement which can be activated by a drive control, which moves the load-bearing means up and down. Furthermore, an energy store is provided, for example, which supplies the drive control and the operating arrangement with energy. Such drive arrangements can, for example, be designed as single-column lifting platforms, which form a lifting system for lifting, in particular, vehicles in pairs, fours or similar.

A lifting platform for motor vehicles is known from DE 833 684 B1, which has a lighting fixture provided in a channel adjacent to the lifting platform and an emitter in a base set in the floor of the lifting platform, wherein the emitter is turned on and off automatically by lifting and lowering the platform using a switch.

Furthermore, a lifting platform is known from DE 299 19 217 U1, wherein a light is arranged to the side of the platform for lifting and lowering a wheelchair, so that the platform is always uniformly illuminated while lifting and lowering.

A stationary light for a two-column floor lifting platform is found in DE 1 984 742. Working-area lighting is set in the base on one side or arranged in a vertical column of the lifting platform and forms stationary lighting for the working area.

A lifting platform for motor vehicles is found in DE 91 04 973, comprising two loading ramps which can be moved up and down in a dual-scissor arrangement. Luminescent tubes are arranged on lateral recesses in the loading ramps to illuminate the working area.

In such lifting apparatus, the working area is illuminated; however, it is moreover necessary for the safety of the working area for the operator to be notified of different operating states on or in the working area, in particular disruptive or dangerous situations which can be identified simply by the operator.

SUMMARY OF THE INVENTION

The object of the invention is to propose a lifting apparatus, wherein there is an increased level of working safety.

This object is solved according to the invention by the features of claim 1. Further advantageous embodiments and developments are provided in the further claims.

According to the invention, the lifting apparatus has one or more lighting arrangements, wherein each lighting arrangement comprises working-area lighting and operating-state-display lighting with at least one operating state and wherein each lighting arrangement can be activated by a control arrangement in working-area lighting mode or operating-state display lighting mode or in both modes. Thus, on the one hand, there are optimal working conditions for the operator for or in the working area, and optimal working safety on the other. Due to the embodiment of the lighting arrangement, which comprises working-area lighting and operating-state-display lighting and can be switched on alternately or simultaneously, the operator is directly informed about the current or changing situation. It can, for example, be illuminated with a white light before commencing a lowering movement of the lifting apparatus of the working area, and, when changing to a lowering movement, the lighting arrangement can, for example, be switched from a white light (working-area lighting) to a yellow light (operating-state lighting), or this can be switched on to signal to the operator that the lowering movement has been initiated or that he must immediately abandon it. For example, by maintaining the working-area lighting and activating the operating-state lighting, it is ensured that operator can leave the working area safely in dark surroundings and still be informed about the altered operating state.

Due to the integration of at least the working-area lighting and the operating-state-display lighting in a common lighting arrangement, the production of the lighting fixture can also be simplified, as well as reducing the costs of such lifting apparatus.

In a preferred embodiment of the lifting apparatus, at least one energy store is provided on the lifting apparatus, which supplies the lighting arrangement with energy. Such an energy store, such as an accumulator, for example, has an operating voltage of, for example, 24V and on the one hand enables the drive control to be supplied by this energy store in order to prevent current peaks. Furthermore, the lighting arrangement can thus be supplied with power in a simple fashion.

Furthermore, provision is preferably made for there to be a charging arrangement which can be connected to the energy store or for the energy store to comprise a charging arrangement, and preferably for there to be a charging cable connected lockably to the charging arrangement. This enables the energy store to be charged with a charge current while the lifting apparatus is not in operation, and for the operation itself to be carried out by the energy store. Thus a system can be created independently from a public power network. At the same time, this system is also autarkic in emergency situations, particularly when a public power network is down. This also applies to the activation of the lighting arrangement.

In a further preferred embodiment of the invention, provision is made for the lighting arrangement to consist of a punctiform or planiform lighting body with one or more LED lights. The geometry of the lighting body can be adjusted according to the location. By using LED lights, an appropriate adjustment to the geometry of the lighting body can be enabled in a simple fashion.

The lighting arrangement preferably has at least one multi-coloured LED light or at least one light comprising a number of RGB LEDs or at least one light module from several LED lights differing by colour, which can be activated individually or in combination with each other. These embodiment possibilities particularly enable an immediate exchange from working-area lighting or a non-lighting state to operating-state-display lighting, and vice versa, whereby not only a fast changeover, but also a fast activation of the lighting for immediate signal emission, is enabled.

Furthermore, the lighting arrangement is designed to display one or more operating states. In particular, the different operating states can be activated by the drive arrangement and displayed by a change in colour and/or a selection of a predetermined lighting intervals or steady lighting and/or by lighting sequences following each other in a different order. These can be programmed accordingly and varied in terms of both the colour setting of the emitted display light and in terms of the duration. Thus both a steady light and a flashing light can be activated at different intervals. Additionally, a repetition of the same colour, an alternative colour or a sequence of colours can be activated to emit a defined operating state display. Since the changes in lighting are emitted by the same lighting arrangement and these are particularly allocated to the working area, there is an increased level of operating safety.

Alternatively, or additionally, an acoustic signal can also be emitted as an accompaniment to displaying the different operating states.

Furthermore, provision is preferably made for the control arrangement of the lighting arrangement to emit a signal for the colour "green" for a state of operational readiness, a signal for the colour "red" when there is an operating fault, or a signal for the colour "yellow" during lifting and lowering. Thus characteristic operating states can be visualised with characteristic colours without requiring any additional acoustic signal support.

Furthermore, the lifting apparatus preferably has a brightness sensor which, depending on the brightness in the working area, activates both an automatic on and off-switching as well as regulating the brightness of the lighting arrangement for working-area lighting. Thus the working-area lighting is adjusted, for example, in changing weather, such as from very sunny weather to cloudy or thundery weather, without the operator having to leave his work station. Furthermore, the lighting arrangement can preferably be switched on automatically for working-area lighting by lowering the brightness in the working area according to an adjustable lux value. Likewise, it can be switched off automatically as soon as the surrounding brightness is sufficient for the working area. This further simplifies operation and increases working safety.

In a further preferred embodiment of the invention, the lighting arrangement is integrated into a component of the lifting apparatus or is at least partially contained therein. This enables the previously occupied building space of a lifting apparatus to be maintained and furthermore for the lighting arrangement or a potential housing for the lighting arrangement to be contained in such a way as to protect it from damage. Due to this at least partial integration, a housing for the lighting arrangement can even be dispensed with.

In a further preferred embodiment of the lifting apparatus, a transmission surface of the lighting arrangement is aligned flush with a component surface. Thus a complete integration of the lighting arrangement can be enabled. The design of the lifting apparatus is thereby not influenced disadvantageously.

The transmission surface is preferably designed as being shock-proof and/or shatterproof. Thus different areas can be provided and enabled for integrating the lighting arrangement of the lifting apparatus.

In a preferred embodiment of the lifting apparatus, the lighting arrangement is arranged on a chassis or ground frame of the lifting arrangement, particularly a lifting column of a single-column lifting platform, on the load-bearing means or on a base plate facing the working area. For example, when arranging the lighting arrangement on a chassis or lifting arrangement, particularly for a mobile lifting apparatus, there is the advantage that the lighting of the working area and the operating state displays are provided at the same position and are thereby operated together automatically.

The arrangement of the lighting arrangement according to the invention for a lifting apparatus can be provided for a scissor platform, a stationary or mobile two-column lifting platform, a rail lifting platform or on a pit lift or an axle lifter. The advantages described above are also obtained in these lifting apparatus.

BRIEF DESCRIPTION OF THE DRAWINGS

The invention and further advantageous embodiments and developments of the same are described and illustrated in greater detail by means of the examples depicted in the figures. The features which can be gleaned from the description and the figures can be applied individually or in any combination with the others according to the invention. The following are shown.

DETAILED DESCRIPTION

Figure 1:
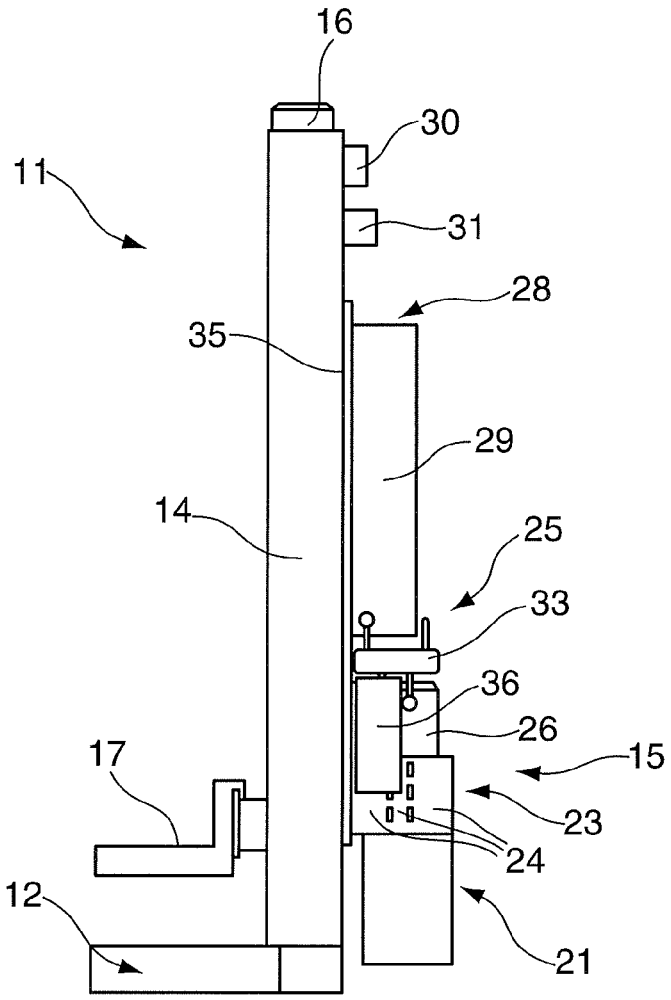
FIG. 1 shows a schematic side view of a lifting apparatus, which is designed as a single-column lifting apparatus.

In FIG. 1, a schematic side view of a lifting apparatus 11 according to the invention is depicted, which is suitable for mobile use, for example. Such lifting apparatus 11 are also identified as single-column lifting apparatus. The lifting apparatus 11 has a base arrangement 12, which preferably comprises a chassis or steerable chassis according to the exemplary embodiment. Alternatively, the base arrangement 12 can also be designed as a supporting plate or a mounting plate, whereupon the lifting apparatus 11 is attached to the floor of a workshop or a mobile or stationary working area.

A lifting arrangement 14 is provided on the base arrangement 12 in the form of a lifting column. A drive arrangement 15 is attached to the lifting column 14, which moves a carrier 16 up and down relative to the lifting column 14. A load-bearing means 17 is provided on the carrier 16 to grip underneath a load which is to be raised. In a single-column lifting platform, it is preferable for the load-bearing element 17 to be designed as a radial gripping element. Other applications are also possible.

The drive arrangement 15 comprises an hydraulic unit 21, which actives a working cylinder that is preferably arranged within the carrier 16. Alternatively, the drive arrangement 15 can also be designed as an electrical or mechanical activation unit, so that, for example, a spindle drive or similar can also be activated. To activate the hydraulic unit 21, an hydraulic control unit 23 is provided, which in turn is activated by a drive control 25. This drive control 25 regulates the overall operation of the lifting apparatus 11.

An electric motor 26 is provided between the drive control 25 and the hydraulic control unit 23, which in turn controls the hydraulic unit 21. A fast-exchange arrangement 28, for example, may be provided above the drive control 25, which contains one or more energy stores 29 for supplying energy to the lifting apparatus exchangeably.

Further sensors 30, 31 are provided, for example, via further wiring, either for the detection of a upper lifting stop position and/or for disconnecting a mechanical fall arrestor or for detecting brightness in the working area of the lifting apparatus 11.

The arrangement described above and the design of the overlapping components is advantageous in that a compact arrangement and short connecting cable are provided, so as to activate the individual components based on the drive control 25. Provision is preferably made for the individual connecting cables to be designed with plug connections, so that there is a simple modular design.

In this embodiment, a separate control board 33 is depicted, which is contact with a charging arrangement 36, as is preferably provided in any case. A charging cable which is not depicted in greater detail can be attached to this charging arrangement. Thus the energy store 29 can be charged either by an external power supply via the charging cable and the charging arrangement 36 or in a separate charging station, wherein the energy store can be shut off.

Additionally, it is advantageous to provide a mounting plate 35 to the lifting arrangement 14, to which all components described above are connected, whereby a modular design and fast mounting of such a lifting apparatus 11 are enabled.

Such a single-column lifting platform is mostly operated in pairs or with a plurality thereof. The drive controls 25 can thus communicate together via cables linked individually with lifting columns or wirelessly.

Figure 2:
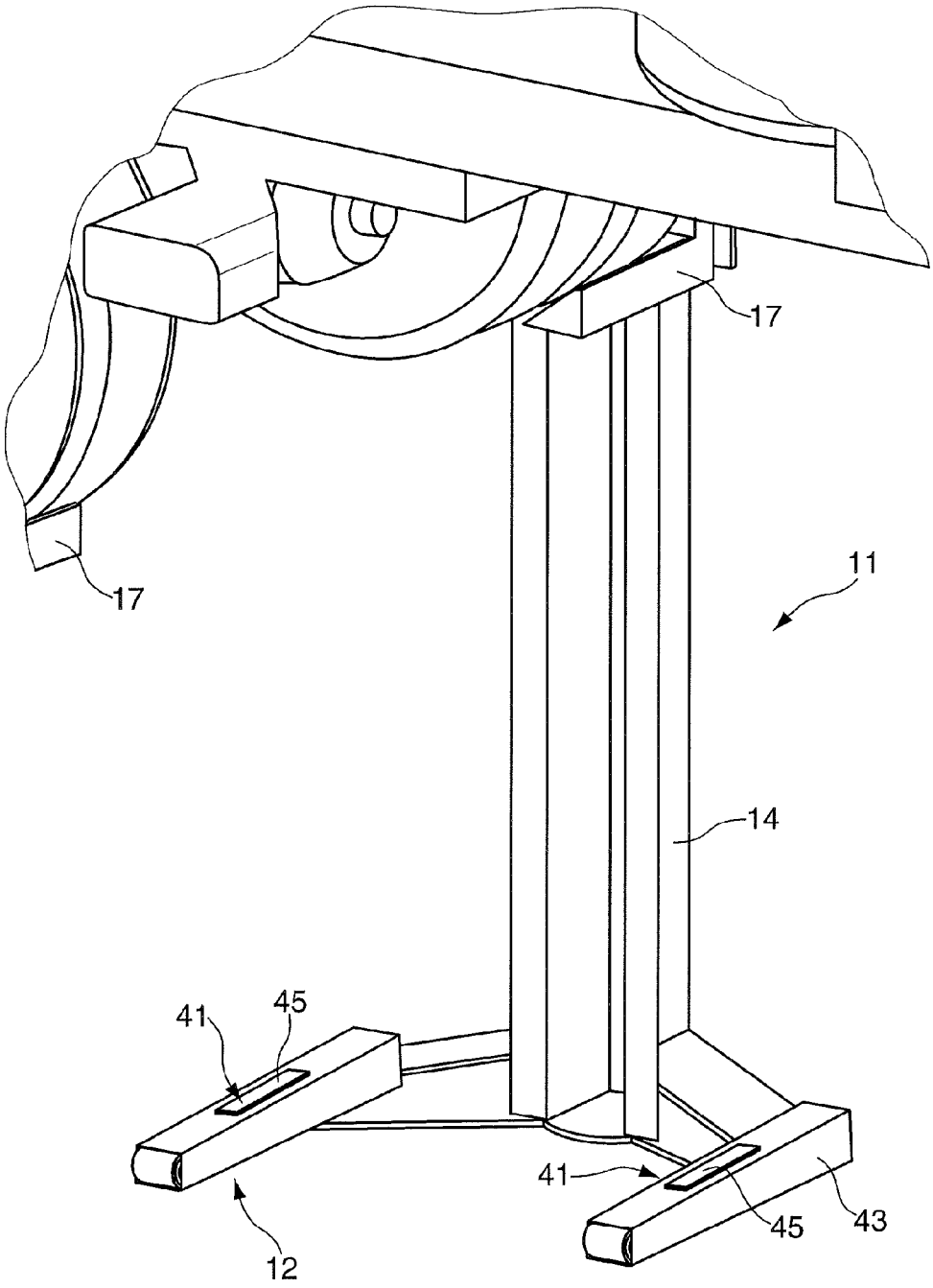
FIG. 2 shows a perspective view of the lifting apparatus according to FIG. 1 with a lighting arrangement according to the invention.

Such a lifting apparatus 11 is depicted in FIG. 2 in a working position. The load-bearing means 17 grips underneath a wheel or a pair of wheels of a vehicle. In this working position, the vehicle is fully lifted off the floor and the underside of the vehicle is freely accessible.

At least one lighting arrangement 41 is provided on the lifting apparatus 11 for lighting the working area underneath the lifted load, in particular underneath the vehicle and/or underneath the lifting apparatus, the beam direction and/or beam cone of which points towards the working area. In the exemplary embodiment according to FIG. 2, the lighting arrangement 41 is arranged on the base arrangement 12 or on a base frame, preferably with rollers, so that the beam cone of the light arrangement 41 is aligned from bottom to top. Thus beam angle can be simultaneously provided in such a way that it extends from an external side of the vehicle to at least the middle of the vehicle and illuminates at least a small area in front of and behind the load-bearing means 17 in the longitudinal direction of the vehicle. As long as, for example, two lighting arrangements 41 are provided on the base arrangement, as is depicted in the exemplary embodiment, the beam cones of the respective light arrangements 41 can also cross over one another or at least adjoin one another, so that an extensive illumination of the working area is enabled. The lighting arrangement 41 is preferably integrated into a carrier profile 43 of the base arrangement 12 in this exemplary embodiment, so that only one transmission surface 45 is provided on a surface of the carrier profile 43. This transmission surface 45 can consist of shock-proof or shatterproof glass or synthetic material. With this arrangement, integration of the lighting arrangement into the lifting apparatus 11 is enabled, so that no additional building space is required. At the same time, the connector leads can be used within the carrier profile 43 and within the lifting column 14 up to the drive control 25.

Figure 3:
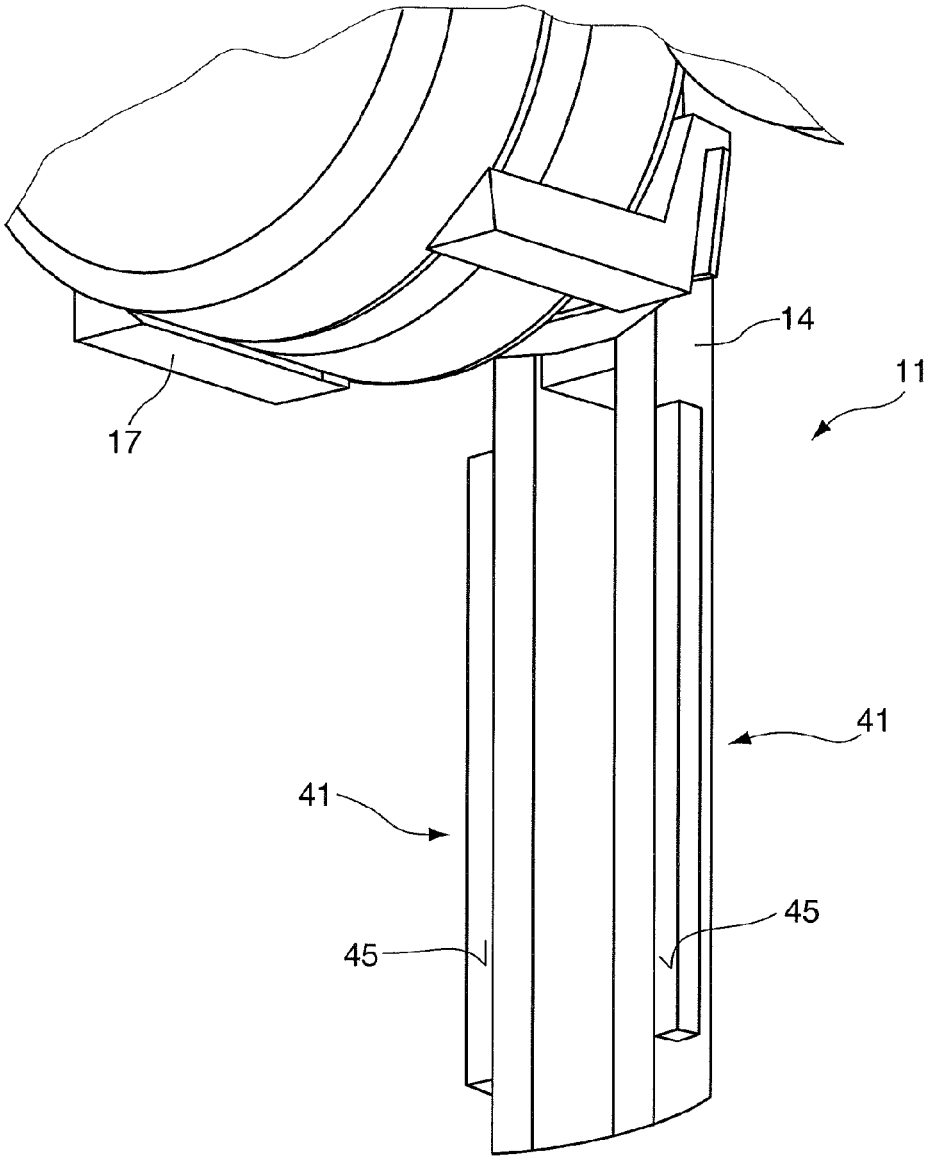
FIG. 3 shows a perspective view of the lifting apparatus with an alternative embodiment of the lighting arrangement to FIG. 2.

An alternative arrangement possibility of the lighting arrangement 41 to FIG. 2 is depicted in FIG. 3. In this arrangement, the lighting arrangement 41 is adjusted lengthwise along the lifting arrangement 14. It is preferably for a lighting arrangement 41 to be arrangement on every side wall of the lifting column 14. In this embodiment, provision is made for the beam cone to extend primarily in an axial direction of the vehicle and furthermore to comprise another beam angle to the underside of the vehicle and to the floor.

Figure 4:
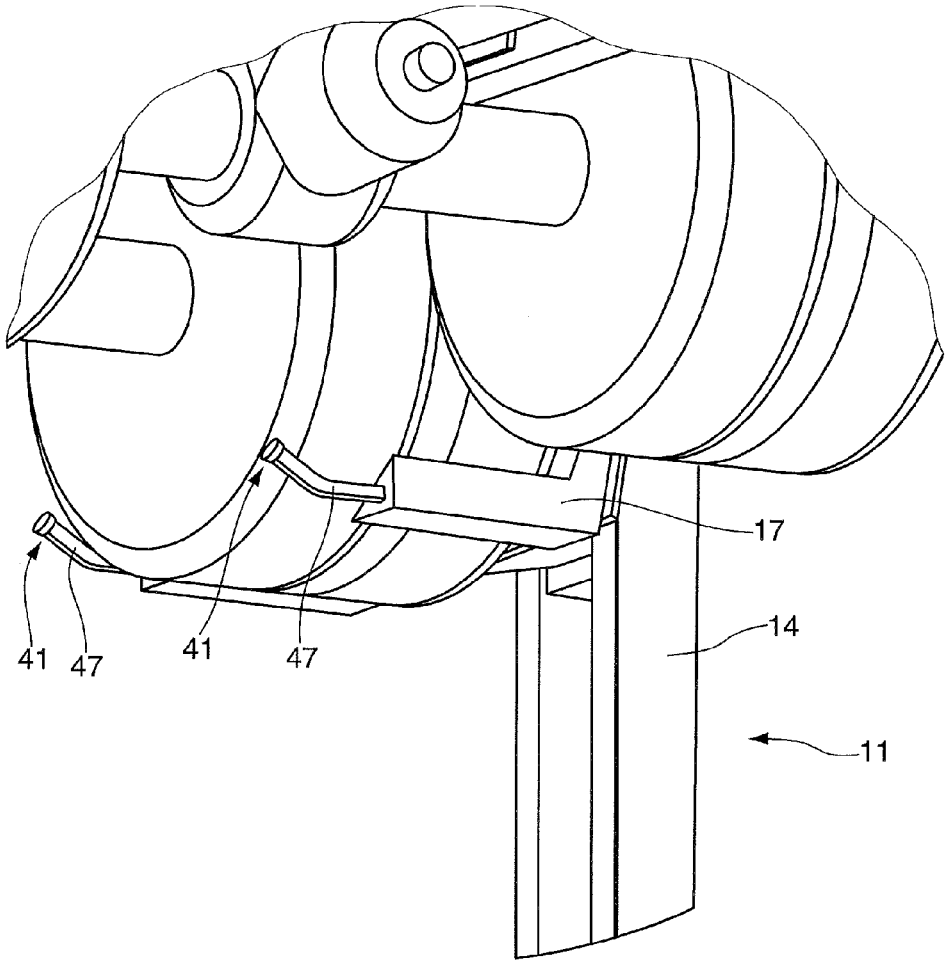
FIG. 4 shows a perspective view of the lifting apparatus with an alternative embodiment of the lighting arrangement to FIG. 2.

A further alternative embodiment and arrangement possibility of the lighting arrangement 41 is provided in FIG. 4. This embodiment comprises, for example, a rod-shaped carrier 47, at the free end of which the lighting arrangement 41 is arranged. This rod-shaped carrier 47 is arranged to extend or retract into a bracket of the load-bearing means, so that this can be extracted for use when necessary. Alternatively, a lighting arrangement 41 can even be provided on one or more side walls of the carrier 47, so as to enable a sort of surround lighting by means of the carrier.

Lighting arrangements 41 with lighting bodies are used in the above embodiments, comprising working-area lighting and operating-state-display lighting. This means that, on the one hand, a steady light can be emitted for lighting the working area and, independently of whether the working-area lighting is switched on or off, an operating state display is possible due to the operating-state-display lighting. The at least one lighting arrangement 41 is preferably attached rigidly to the lifting platform and arranged or assembled thereon. Alternatively, this can also be provided separately and connected to the lifting platform using a cable.

A lighting body of one or more LED lights is preferably provided. Thus several individual LEDs of different colours or so-called RGB LEDs (red-green-blue LEDs) can be used. Different modules can even be used, which combined the LEDs of different colours with one another, so that both a white light and different-coloured lights are to be emitted. Depending on the breadth, length, gradient and geometry of the lighting arrangement 41, the individual LEDs and the LED module can be arranged and designed in line with one another.

For example, provision is made for a white or almost white light to be emitted by the lighting arrangement 41 as working-area lighting, in order to illuminate the working area or working space. In particular, provision can also be provided for there to be detection of increased darkening of the working area using an additional sensor, so that, for example, autonomous switching-on of the lighting arrangement can be provided for illuminating the working space.

Furthermore, provision can be made for a light signal to be emitted as an operating state display before initiation or during a still-incomplete initiation of several single-column lifting platforms to be configured to one another, for example a yellow light signal with a predetermined flashing frequency or a constant yellow light, so as to indicate to the operator that the configuration and/or synchronisation of the individual lifting columns is currently being carried out. As soon as the system has been configured, it can be displayed that it is ready for operation by, for example, switching to a green light in the lighting arrangement 41. As soon as a lifting movement has been carried out, switching the operating state display from green to signal that it is ready for operation can give way to a yellow, flashing colour, to signal that the lifting apparatus is currently in a state of lifting. After the load-bearing means 17 has achieved an upper lifting stop position, the green signal of the operating state display can in turn light up to show that the lifting movement has been completed. Likewise, a change in the illumination of the working space can take place. Alternatively, a short green signal can first be emitted to signal the lifting stop position and then a changeover to the illumination of the working area.

Also, while illuminating the working area and when the lighting arrangement is not operation, a "red colour" signal can be emitted, for example, as a further operating state display when there is a disruption, to signal this state, meaning that the working space should be immediately vacated and appropriate further measures are to be taken to rectify the disruption. Furthermore, a signal for a yellow light can in turn be emitted as a further operating state display when there is a lowering movement, in particular so as to also signal a crushing zone, particularly during lowering.

The lighting of the various operating states described above and the lighting of the working area is carried out by the same lighting arrangement 41, wherein not only one, but also several such lighting arrangements 41 are provided on a lifting apparatus 11, wherein these are always activated synchronously by the control arrangement at least according to the operating state displays. When there are several single-column lifting platforms, the control arrangement is preferably provided on a central board for each, by which the activation is carried out. The individual lifting columns are each activated separately by a central control unit, so that a central and mutual activation of the individual and respective lifting columns is possible. Alternatively, the lifting columns can communicate directly with one another.

The operating state of the working-area lighting can be optionally switched on or off when there are several lighting arrangements 41.

Due to the preferred embodiment of the lifting apparatus 11 with an energy store, the LED lights are particularly suited to the design of the lighting arrangement 41.

The embodiment and activation of the lighting arrangement 41, which, for example, is described as a lifting apparatus 11 on a single-column lifting platform, can also be transferred and integrated on all further lifting apparatus 11 for lifting and lowering loads, in particular vehicles.

Figure 5:
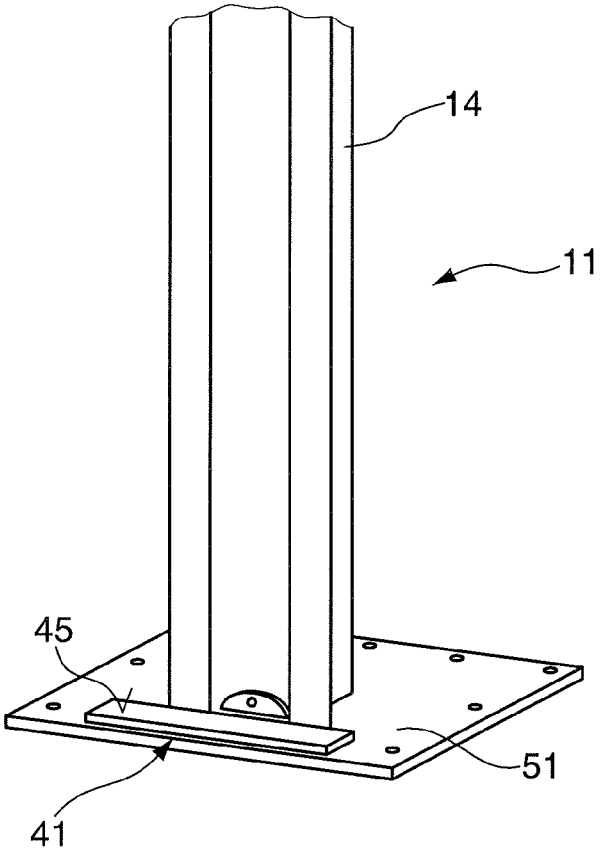
FIG. 5 shows a perspective view of a further alternative lifting apparatus with a lighting arrangement according to the invention.

As an example, a stationary lifting apparatus 11 is depicted in FIG. 5, comprising consoles, for example, which contain a cross beam. In this embodiment, provision is made for the lighting arrangement 41 to be integrated in a base plate 51 of the lifting column 14. Additionally or alternatively, the exemplary embodiments of the lighting arrangement 41 described above can be provided individually or cumulatively on the lifting arrangement 14 or the lifting column and/or the load bearing means 17 for a stationary lifting apparatus 11.

Figure 6:
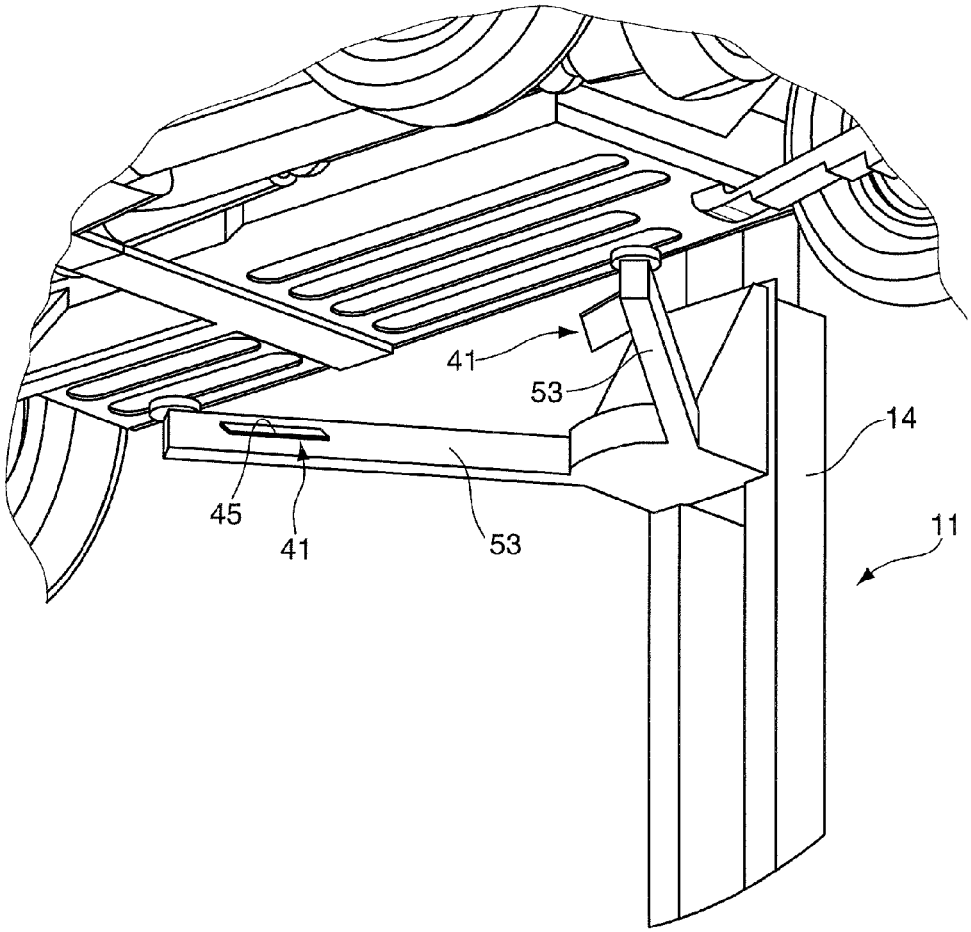
FIG. 6 shows a perspective view of a further alternative lifting apparatus with a lighting arrangement according to the invention.

A further alternative embodiment of the lifting apparatus 11 to FIGS. 2 and 5 is depicted in FIG. 6. Such a two-column lifting platform can be designed as either mobile or stationary. The load-bearing means has two load arms 53, which engage with two sill areas on a passenger car. To illuminate the undercarriage and the neighbouring areas at the axles of the vehicle directly, the lighting arrangements 41 are preferably integrated into the load arms 53. The wiring can in turn be conveyed within the load arms 53 into the lifting column 14 up to the control arrangement 25. Thus an integrated arrangement is once more created in this embodiment. On the one hand, the lighting arrangement 41 can only be directed in the direction of the vehicle's undercarriage. On the other hand, this can also serve as lighting for the working area below it.

Figure 7:
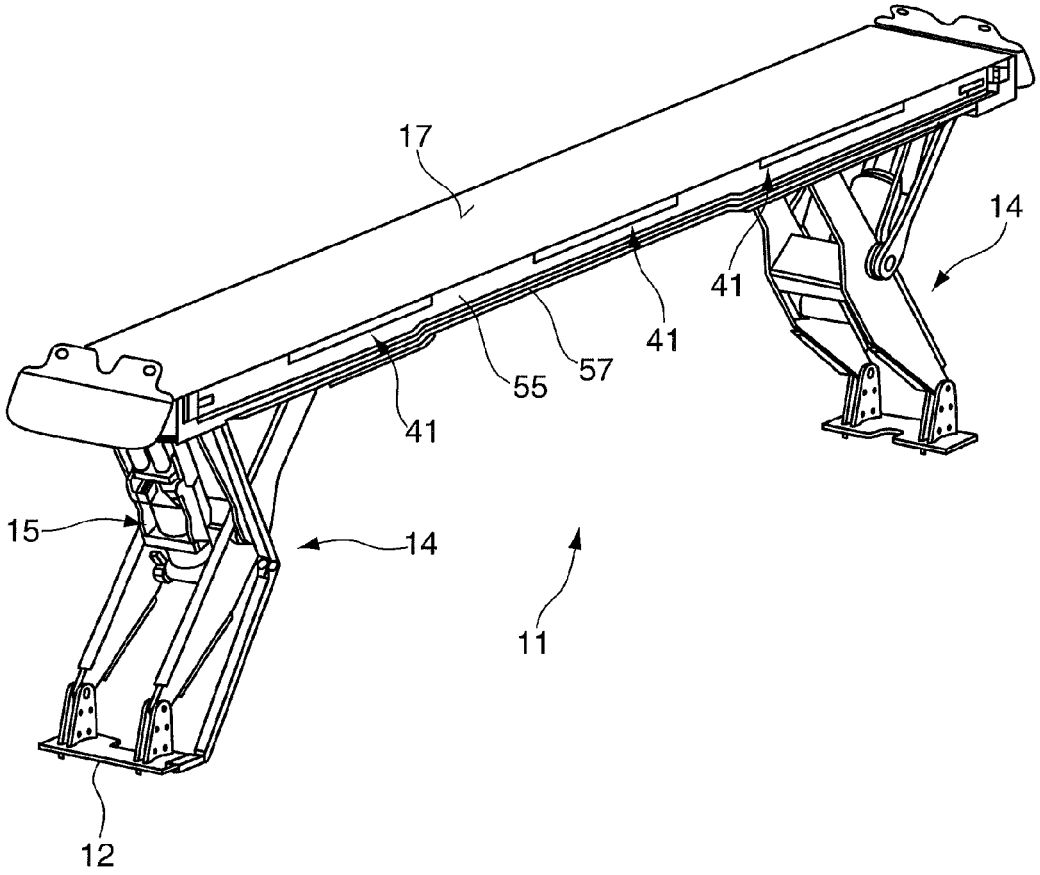
FIG. 7 shows a perspective view of a further alternative lifting apparatus with a lighting arrangement according to the invention.

A lifting apparatus 11 is depicted perspectively in FIG. 7, which is designed as a rail lifting platform. This lifting apparatus 11 comprises as its load-bearing means 17 a rail that can be moved up and down by two lifting arrangements 14. In the exemplary embodiment, the lifting arrangement 14 is designed as a half-pincer. Also, a dual pincer or further alternative embodiments can be provided. This lifting arrangement 14 comprises a drive arrangement 15, the individual components of which are not depicted in greater details, but which correspond to the embodiments described above. Also, this lifting apparatus 11 can have at least one energy store and a charging arrangement.

Such lifting apparatus 11 are used in pairs with each other and have load-bearing means 17 and/or rails. One or more lighting arrangements 41 are preferably arranged on a side wall 55 or side wall of the load-bearing means 17, which point towards a rail and/or load-bearing means 17 opposite which is not depicted here, and/or which are adjusted to the floor in-between. The lighting arrangement 41 is thus arranged on the side wall 55 in such a way that an axleless lifter can be arranged displaceably on a running surface 57 arranged on the side wall 55. This lighting arrangement 41 can also be integrated partially or fully into the carrier body of the load-bearing means 17. Also, this lighting arrangement 41 can only be fitted edgewise to the side wall 55. Additionally and/or alternatively, at least one lighting arrangement 41 can also be provided on the lifting arrangement. Incidentally, the embodiments and alternative embodiment possibilities described above are also valid for the lifting apparatus 11 according to FIG. 7.

The invention claimed is:

1. A lifting apparatus for lifting and lowering loads, the lifting apparatus comprising a lifting arrangement, on which a load-bearing member is arrangeable, a drive arrangement which moves the load-bearing member up and down, and a control arrangement which activates the drive arrangement and one or more lighting arrangements, wherein the lighting arrangement is integrated into a component of the lifting apparatus or is at least partially contained therein, and wherein each lighting arrangement has a working-area lighting and an operating-state-display lighting for displaying at least one operating state, and in that each lighting arrangement is activated by the control arrangement in a working-area lighting mode or an operating-state display lighting mode or in both modes.

2. The lifting apparatus according to claim 1, wherein at least one energy store is provided, which supplies the lighting arrangement with energy.

3. The lifting apparatus according to claim 2, wherein a charging arrangement is connected to the energy store or in that the energy store comprises a charging arrangement.

4. The lifting apparatus according to claim 1, wherein the lighting arrangement consists of a punctiform or planiform lighting body with one or more LED lights.

5. The lifting apparatus according to claim 1, wherein the lighting arrangement has at least one multi-colored LED light or at least one RGB LED light or at least one light module from several LEDs differing by color, which are activated individually or in combination.

6. The lifting apparatus according to claim 1, wherein the lighting arrangement is designed for displaying one or more operating states by a change in color or lighting intervals or steady lighting or lighting sequences or all of them.

7. The lifting apparatus according to claim 1, wherein the control arrangement emits a signal for the color "green" when the lifting apparatus is in a state of operational readiness, emits a signal for the color "red" when there is an operating fault, or emits the color "yellow" during lifting and lowering of the load-bearing member.

8. The lifting apparatus according to claim 1, wherein a brightness sensor is provided, which, depending on the brightness in the working area, activates both an automatic on and off-switching as well as regulating the brightness of the lighting arrangement for working-area lighting.

9. The lifting apparatus according to claim 1, wherein a transmission surface of the lighting arrangement is aligned flush with a surface of a component of the lifting apparatus.

10. The lifting apparatus according to claim 9, wherein the transmission surface is designed as being shock-proof or shatterproof or both.

11. The lifting apparatus according to claim 1, wherein the lighting arrangement is arranged on a base arrangement or a base frame or a ground frame of the lifting arrangement or on a load-bearing member, and is pointing towards the working area.

12. The lifting apparatus according to claim 1, wherein the lighting arrangement is provided on a pincer platform, a stationary or mobile two-column lifting platform, a rail lifting platform or on a pit lift or an axle lifter.

13. The lifting apparatus according to claim 3, wherein a charging cable is connectable to the charging arrangement.

* * * * *